US012582279B2

(12) United States Patent
Beninato et al.

(10) Patent No.: US 12,582,279 B2
(45) Date of Patent: Mar. 24, 2026

(54) WASHING APPLIANCE WITH RECIRCULATION PUMP

(71) Applicant: ELECTROLUX APPLIANCES AKTIEBOLAG, Stockholm (SE)

(72) Inventors: Daniele Beninato, Porcia (IT); Riccardo Prota, Porcia (IT); Sandro Brovedani, Porcia (IT); Alberto Bisutti, Porcia (IT); Viktor Kozma, Porcia (IT); Arne Nensen, Stockholm (SE); David Persson, Stockholm (SE); Conny Finne, Stockholm (SE)

(73) Assignee: Electrolux Appliances Aktiebolag, Stockholm (SE)

( * ) Notice: Subject to any disclaimer, the term of this patent is extended or adjusted under 35 U.S.C. 154(b) by 110 days.

(21) Appl. No.: 18/721,606

(22) PCT Filed: Dec. 22, 2021

(86) PCT No.: PCT/EP2021/087401

§ 371 (c)(1),
(2) Date: Jun. 18, 2024

(87) PCT Pub. No.: WO2023/117091

PCT Pub. Date: Jun. 29, 2023

(65) Prior Publication Data

US 2025/0057385 A1 Feb. 20, 2025

(51) Int. Cl.
*A47L 15/00* (2006.01)
*A47L 15/42* (2006.01)

(52) U.S. Cl.
CPC ..... *A47L 15/0049* (2013.01); *A47L 15/4219* (2013.01); *A47L 15/4225* (2013.01);
(Continued)

(58) Field of Classification Search
CPC ..... A47L 15/0049; A47L 15/4219; A47L 15/4225; A47L 2401/08; D06F 33/47; D06F 39/082; D06F 39/085
See application file for complete search history.

(56) References Cited

U.S. PATENT DOCUMENTS

2005/0005952 A1 1/2005 Bashark
2014/0360530 A1 12/2014 Pers et al.
(Continued)

OTHER PUBLICATIONS

International Search Report and Written Opinion dated Feb. 9, 2022 of International Patent Application No. PCT/EP/2021/087401.

*Primary Examiner* — Spencer E. Bell
(74) *Attorney, Agent, or Firm* — Chrisman Gallo Tochtrop LLC

(57) ABSTRACT

A washing appliance comprising a tub to house items to be washed; a circulation pump (130) to circulate a washing fluid in the tub; a circulation pump motor to drive the circulation pump; a drain pump; a detection unit configured to monitor at least one electromechanical parameter of the circulation pump motor, and to detect, based on the monitored at least one electromechanical parameter, a starvation event indicating that air is drawn out by the circulation pump or a saturation event indicating that no air is drawn out by the circulation pump: a control unit configured to determine a first starvation event and a second starvation event occurred after the first starvation event, wherein the first starvation event is determined when a starvation event is detected after a first number of consecutive saturation events (N1) is counted, or after a first time interval (ΔT1) has elapsed during which no starvation event is detected, and wherein the second starvation event is determined when a starvation event is detected before a second number of consecutive saturation events (N2) is counted after the first starvation event, or before a second time interval (ΔT2) has
(Continued)

elapsed after the first starvation event during which no starvation event is detected.

20 Claims, 9 Drawing Sheets

(52) U.S. Cl.
CPC ..... *A47L 2401/08* (2013.01); *A47L 2401/20* (2013.01); *A47L 2501/01* (2013.01)

(56) References Cited

U.S. PATENT DOCUMENTS

2019/0174989 A1 6/2019 Persson et al.
2020/0277719 A1* 9/2020 Driussi ..... F04B 43/12

* cited by examiner

WASHING APPLIANCE WITH RECIRCULATION PUMP

CROSS-REFERENCE TO RELATED APPLICATIONS

This application is a national stage under 35 U.S.C. § 371 of International Application No. PCT/EP2021/087401, filed Dec. 22, 2021, the entire disclosure of which is incorporated by reference herein.

FIELD OF THE INVENTION

The present invention generally relates to the field of dishwashers. Particularly, the present invention relates to dishwashers provided with circulation pump. More particularly, the present invention relates to a dishwasher capable of reliably determining saturation and starvation states of the circulation pump.

BACKGROUND OF THE INVENTION

A conventional dishwasher comprises a tub configured to house items to be washed (such as dishes, cutlery, drinking glasses), and a door for providing selective access to the tub.

A conventional dishwasher also comprises a sump in fluid communication with a bottom portion of the tub, and configured to collect a washing fluid reaching the tub and detergent discharged from a detergent compartment.

A conventional dishwasher further comprises a circulation pump in fluid communication with the sump (and, hence, with the tub), and configured to circulate the washing fluid in the tub. Particularly, when the circulation pump is rotated in a predefined direction, the washing fluid leaves the sump and re-enters the tub (e.g., by means of proper spray devices).

A conventional dishwasher further comprises a circulation pump motor for driving the circulation pump. The circulation pump motor may typically comprise a respective electric motor and a respective motor command element (such as a TRIAC) for commanding the electric motor.

During operation, the circulation pump may experience a saturation state or a starvation state.

When the circulation pump experiences the saturation state, the amount of washing fluid in the tub is sufficient or high enough to prevent air drawing by the circulation pump.

When the circulation pump experiences the starvation state, the amount of washing fluid in the tub is insufficient or not high enough to prevent air drawing by the circulation pump.

SUMMARY OF THE INVENTION

The Applicant has found that reliably determining the saturation or starvation state of the circulation pump is of the upmost importance to ensure correct operation of the dishwasher.

The Applicant is aware that by monitoring or measuring one or more electromechanical parameters of the circulation pump motor (such as an electric current drawn by the circulation pump motor, a voltage across the circulation pump motor, and/or a torque of the circulation pump motor), the saturation or the starvation state of the circulation pump could be determined.

Particularly, for each electromechanical parameter monitoring or measuring event, a corresponding air drawing by the circulation pump (starvation event) or a corresponding no-air drawing by the circulation pump (saturation event) may be determined.

However, the Applicant has understood that by merely associating each saturation event with the saturation state (or, equivalently, each starvation event to the starvation state) could be unreliable in practical conditions in which spurious (saturation or starvation) events may often or relatively often arise. Spurious (saturation or starvation) events may for example result from transitory or temporary conditions, such as air bubbles due to turbulent motion of the washing fluid resulting from circulation pump: in these cases, a spurious (saturation or starvation) event would be erroneously interpreted as a (saturation or starvation, respectively) state of the circulation pump.

The Applicant has faced the above-mentioned issues, and has devised a dishwasher capable of reliably determining, based on a trend of the detected (saturation or starvation) events, a saturation state or a starvation state of the circulation pump.

One or more aspects of the present invention are set out in the independent claims, with advantageous features of the same invention that are indicated in the dependent claims, whose wording is enclosed herein verbatim by reference (with any advantageous feature being provided with reference to a specific aspect of the present invention that applies mutatis mutandis to any other aspect).

More specifically, an aspect of the present invention relates to a washing appliance. The washing appliance comprises a tub to house items to be washed. The washing appliance comprises a circulation pump to circulate a washing fluid in the tub. The washing appliance comprises a circulation pump motor to drive the circulation pump. The washing appliance comprises a drain pump. The washing appliance comprises a detection unit configured to monitor at least one electromechanical parameter of the circulation pump motor, and to detect, based on the monitored at least one electromechanical parameter, a starvation event indicating that air is drawn out by the circulation pump or a saturation event indicating that no air is drawn out by the circulation pump. The washing appliance comprises a control unit configured to determine a first starvation event and a second starvation event occurred after said first starvation event. The first starvation event is determined when a starvation event is detected after a first number of consecutive saturation events is counted, or after a first time interval has elapsed during which no starvation event is detected. The second starvation event is determined when a starvation event is detected before a second number of consecutive saturation events is counted after the first starvation event, or before a second time interval has elapsed after the first starvation event during which no starvation event is detected. Said first number of consecutive saturation events is higher than said second number of consecutive saturation events, and said first time interval is higher than said second time interval.

The control unit is configured to:

determine a starvation state of the circulation pump when both the first starvation event and the second starvation event are determined, said starvation state indicating that insufficient washing fluid is present in the tub to prevent air from being drawn out by the circulation pump;

determine a saturation state of the circulation pump if said second starvation event is not determined, said saturation event indicating that sufficient washing fluid is present in the tub to prevent air from being drawn out by the circulation pump, and control the washing appliance based on the determined starvation state or saturation state of the circulation pump.

According to an embodiment, after the starvation state is determined, the control unit is configured to determine a saturation state of the circulation pump after a third number of consecutive saturation events is counted from determination of the starvation state, or after a third time interval has elapsed from determination of the starvation state during which no starvation event is detected.

According to an embodiment, said second number of consecutive saturation events is equal to said third number of consecutive saturation events, and said second time interval is equal to said third time interval.

According to an embodiment, with the circulation pump in the saturation state, the control unit is configured to determine a starvation state of the circulation pump if a third starvation event is detected before said first number of consecutive saturation events is counted from determination of the saturation state, or before said first time interval has elapsed from determination of the saturation state, said third starvation event not following the first starvation event.

According to an embodiment, the control unit is configured to pause the operation of the detection unit for a predefined time interval after the first starvation event is determined, and to resume the operation of the detection unit after the predefined time interval has elapsed.

According to an embodiment, said predefined time interval is lower than said first time interval.

According to an embodiment, the first number of consecutive saturation events and the first time interval are indicative of a stable saturation state of the circulation pump.

According to an embodiment, the at least one parameter comprises an electric current of the circulation pump motor.

According to an embodiment, the control unit is configured to control the washing appliance based on the determined starvation state or saturation state of the circulation pump by controlling a washing fluid filling and/or the circulation pump and/or the drain pump.

According to an embodiment, the washing appliance further comprises an inlet valve operable to be selectively switched between an open condition for causing the washing fluid to be loaded into the tub, and a closed condition for preventing the washing fluid be fed to the appliance. The control unit is configured to control a washing fluid filling by controlling a switch of the inlet valve between the open and closed conditions according to the starvation state or saturation state of the circulation pump.

According to an embodiment, the control unit is configured to receive an indication of a current speed of the circulation pump and an indication of a target speed for the circulation pump. Said target speed is based on a user-selected washing cycle and/or on a phase of said user-selected washing cycle. The control unit is configured to control a switch of the inlet valve by:

causing the inlet valve to switch from the open condition to the closed condition if the following two conditions a) and b) are both true:

a) a saturation state of the circulation pump is determined;

b) said current speed of the circulation pump is lower than or equal to said target speed.

According to an embodiment, the control unit is configured to control a switch of the inlet valve further by:

delaying said switch of the inlet valve from the open condition to the closed condition by a delay interval if, in addition to have both the conditions a) and b) that are true, the difference between said target speed and said current speed of the circulation pump is higher than a speed threshold.

According to an embodiment, a duration of said delay interval is based on said difference between said target speed and said current speed of the circulation pump.

According to an embodiment, the control unit is configured to control a washing fluid filling by:

causing the inlet valve to switch from the open condition to the closed condition if, in addition to have the condition a) that is true, the condition b) is not true.

According to an embodiment, the control unit is configured to control a washing fluid filling by:

causing the inlet valve to switch from the open condition to the closed condition if both the conditions a) and b) are not true.

According to an embodiment, the control unit is configured to control a washing fluid filling by:

causing the inlet valve to switch from the closed condition to the open condition if, in addition to have the condition b) that is true, the condition a) is not true.

According to an embodiment, the washing appliance further comprises an inlet valve operable to be selectively switched between an open condition for causing the washing fluid to be loaded into the tub, and a closed condition for preventing the washing fluid be fed to the appliance. The control unit is configured to receive an indication of a current speed of the circulation pump and an indication of a target speed for the circulation pump, and to cause the current speed of the circulation pump to increase towards the target speed. The control unit is configured to control the circulation pump by controlling a speed increase rate of the circulation pump from the current speed towards the target speed according to the starvation state or saturation state of the circulation pump and according to the open and closed condition of the inlet valve.

According to an embodiment, the control unit is configured to cause the current speed of the circulation pump to increase towards the target speed with a first speed increase rate. The control unit is configured to control the speed increase rate of the circulation pump from the current speed towards the target speed by:

causing the current speed of the circulation pump to increase towards the target speed with a second speed increase rate lower than the first speed increase rate, if the following two conditions a) and b) are both true:

a) the starvation state of the circulation pump is determined before the speed of the circulation pump has reached the target speed, and b) the inlet valve is in the open condition.

According to an embodiment, the control unit is configured to control the circulation pump by causing the current speed of the circulation pump to be decreased if the condition a) is true while condition b) is not true.

According to an embodiment, the control unit is configured to control the circulation pump by causing the current speed of the circulation pump to increase towards the target speed with the second speed increase rate if, in addition to have both the conditions a) and b) that are true, no saturation state of the circulation pump is determined during a predetermined time period after the determination of a starvation state of the circulation pump.

According to an embodiment, the control unit is configured to cause the current speed of the circulation pump to increase towards the target speed with a third speed increase rate lower than the first speed increase rate and higher than the second speed increase rate if the circulation pump has reached the target speed before a starvation state of the circulation pump is determined.

According to an embodiment, the control unit is configured to cause the current speed of the circulation pump to increase towards the target speed with the third speed increase rate if, in addition to have the condition a) true, a saturation state of the circulation pump is determined during said predetermined time period.

According to an embodiment, said third speed increase rate is equal to:

a first value if the inlet valve is in the open condition;

a second value lower than the first value if the inlet valve is in the closed condition.

According to an embodiment, said first value of the third speed increase rate is higher than 50 RPM/s, and said second value of the third speed increase rate is lower than 50 RPM/s.

According to an embodiment, said target speed depends on a user-selected washing cycle being carried out by the washing appliance and/or by a phase of said user-selected washing cycle being carried out by the washing appliance.

According to an embodiment, said first speed increase rate is higher than 70 RPM/s, and said second speed increase rate is lower than 10 RPM/s.

According to an embodiment, the control unit is configured to control the washing fluid filling and the circulation pump by controlling at least one washing filling component allowing the washing fluid filling and at least one pump parameter of the circulation pump based on the starvation state or saturation state of the circulation pump, and by controlling the at least one washing filling component and the at least one pump parameter with respect to each other.

According to an embodiment, the at least one washing filling component comprises an inlet valve operable to be selectively switched between an open condition for causing the washing fluid to be loaded into the tub and a closed condition for preventing the washing fluid be fed to the appliance. The at least one pump parameter comprises a target speed of the circulation pump based on a user-selected washing cycle and/or on a phase thereof and a current speed of the circulation pump. The control unit is configured to control the washing fluid filling and the circulation pump by:

controlling the current speed of the circulation pump based on:

said target speed, said inlet valve condition, the starvation state or the saturation state of the circulation pump, and operating the inlet valve based on:

said target speed, said current speed of the circulation pump, and the starvation state or the saturation state of the circulation pump.

BRIEF DESCRIPTION OF THE ANNEXED DRAWINGS

These and other features and advantages of the present invention will be made apparent by the following description of some exemplary and non-limitative embodiments thereof; for its better intelligibility, the following description should be read making reference to the attached drawings, wherein:

FIG. 1 schematically shows a washing appliance according to an embodiment of the present invention:

FIGS. 2A and 2B schematically illustrate exemplary saturation and starvations states, respectively, of a circulation pump of the washing appliance of FIG. 1, according to an embodiment of the present invention;

DETAILED DESCRIPTION OF PREFERRED EMBODIMENTS OF THE INVENTION

Figure 1:
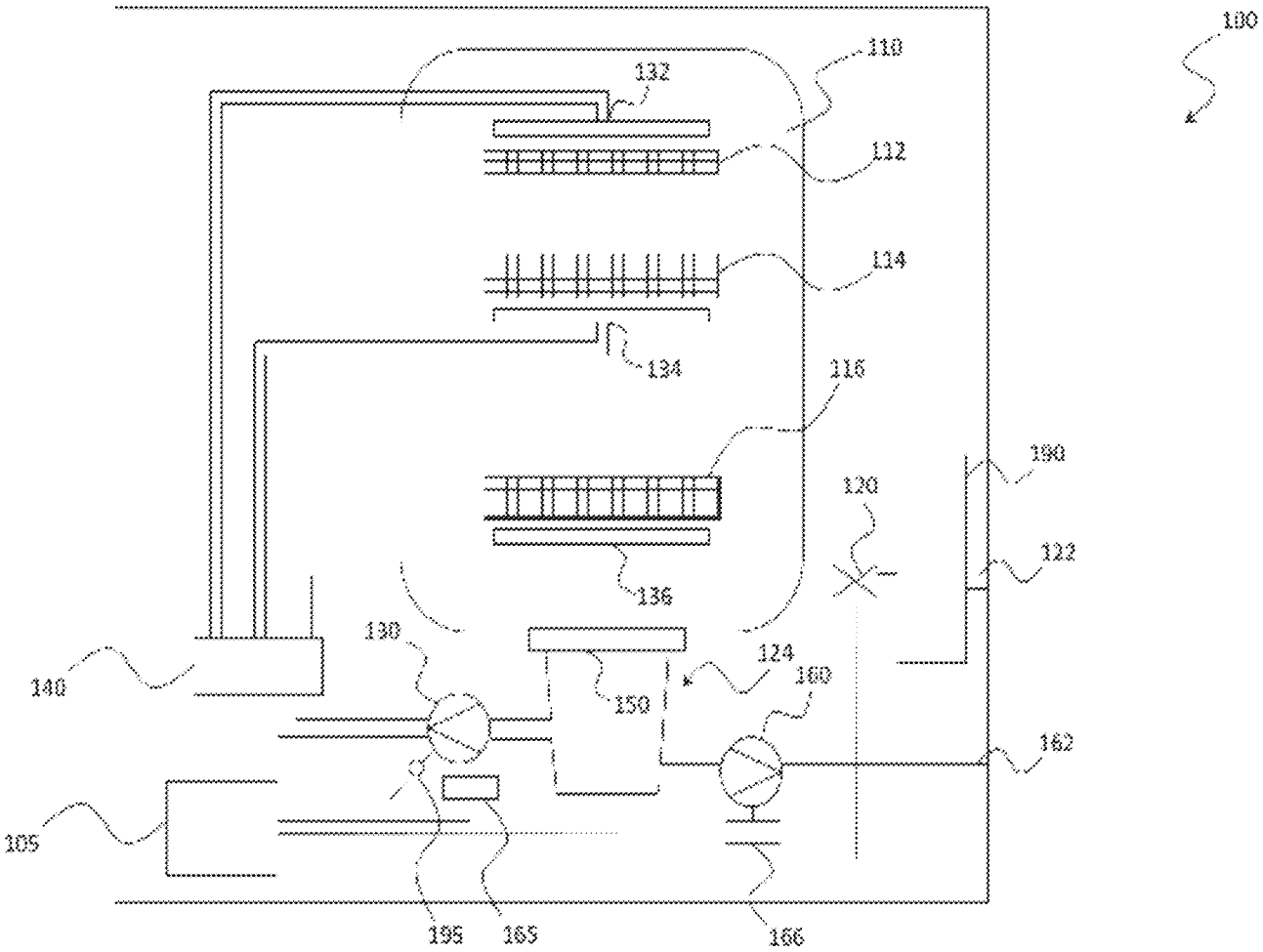

With reference to the drawings. FIG. 1 schematically shows a simplified (not-in-scale) cross-sectional side view of a washing appliance, such as a dishwasher, 100 according to an embodiment of the present invention.

In the following, when one or more features of the dishwasher 100 (as well as of components thereof) are introduced by the wording "according to an embodiment", they are to be construed as optional features additional or alternative to any features previously introduced, unless otherwise indicated and/or unless there is evident incompatibility among feature combinations.

In the following, only features of the dishwasher 100 that are deemed relevant for the understanding of the present invention will be discussed, with well-known features and/or obvious variants of the relevant features that are omitted for the sake of conciseness.

According to an embodiment, the dishwasher 100 comprises a control unit 105 (or more thereof) configured to control an operation of the dishwasher 100.

According to an embodiment, the control unit 105 is configured to control the operation of the dishwasher 100 by carrying out one or more software/firmware routines (discussed in the following) installed/stored in one or more memory units of (or associated with) the control unit 105.

According to an embodiment, the dishwasher 100 comprises a number of well-known hydraulic, electronic, electric and/or electromechanical components (hereinafter globally referred to as dishwasher components).

According to an embodiment, the control unit 105 is configured to control an operation of the dishwasher components (or at least of a subset thereof).

According to an embodiment, the control unit 105 is configured to control the operation of the dishwasher components by running a respective routine (discussed in the following), or more thereof.

According to an embodiment, the dishwasher 100 comprises a tub 110. According to an embodiment, the tub 110 is configured to house items to be washed, such as dishes, cutlery, drinking glasses.

According to an embodiment, the dishwasher 100 comprises one or more baskets for accommodating the items to be washed. According to an embodiment, each basket is provided in the tub 110. According to an embodiment, each basket (or at least a subset of the baskets) is at least partially removably provided in the tub 110.

According to an embodiment, the dishwasher 100 comprises a first basket (or upper basket) 112, a second basket (or middle basket) 114 and a third basket (or lower basket) 116. Just as an example, the upper basket 112 may be configured to accommodate cutlery, and the middle 114 and lower 116 baskets may be configured to accommodate other kinds of items to be washed, such as plates and drinking glasses.

According to an embodiment, the dishwasher 100 comprises a door (not shown in the figure). According to an embodiment, the door is hingedly mounted to a front portion of the dishwasher 100 for providing selective access to the tub 110, and hence to the baskets 112, 114, 116.

According to an embodiment, the dishwasher 100 comprises a detergent compartment (not shown) for storing detergent. Without losing generality, the detergent compartment may be configured to store detergent in form of tablets, liquid, and/or powder. According to an embodiment, the detergent compartment is located at an inside portion of the door of the dishwasher 100. According to an embodiment, during operation of the dishwasher 100, the stored detergent may be controllably discharged, e.g. under the control of the control unit 105, into the tub 110 according to a user-selected washing cycle and/or to a phase thereof.

According to an embodiment, the dishwasher 100 comprises an inlet valve 120 operable (e.g., under the control of the control unit 105) to be selectively switched between an open condition for causing washing fluid (e.g., fresh water provided by a water inlet 122) to be fed to the dishwasher 100 and loaded into the tub 110, and a closed condition for preventing the washing fluid be fed to the dishwasher 100.

According to an embodiment, the dishwasher 100 comprises a sump 124. According to an embodiment, the sump 124 is in fluid communication with a bottom portion of the tub 110. According to an embodiment, the sump 124 is configured to collect the washing fluid reaching the tub 110 (such as fresh water loaded by the inlet valve 120). According to an embodiment, the sump 124 is configured to collect the detergent discharged from the detergent compartment. According to an embodiment, the fresh water (from the tub 110) and the detergent from the detergent compartment mix with each other within the sump 124, so that the resulting washing fluid—also referred to as process water—turns into a mixture of water and detergent.

According to an embodiment, the dishwasher 100 comprises a circulation pump 130. According to an embodiment, the circulation pump 130 is in fluid communication with the sump 124 (and, hence, with the tub 110). According to an embodiment, the circulation pump 130 is configured to be rotated, e.g. under the control of the control unit 105, in a first (or forward) direction and in a second (or backward) direction. According to an embodiment, the circulation pump 130 is configured to circulate the washing fluid in the tub 110 during a user-selected washing cycle and/or a phase thereof. According to an embodiment, the circulation pump 130 is configured to circulate the washing fluid in the tub 110 when the circulation pump 130 is rotated in the forward direction.

According to an embodiment, when the circulation pump 130 is rotated in the forward direction, the washing fluid leaves the sump 124 and re-enters the tub 110 (e.g., from above). According to an embodiment, when the circulation pump 130 is rotated in the forward direction, the washing fluid is caused to leave the sump 124, to pass through one or more conducts and to be sprayed back into the tub 110 by spray devices. According to an embodiment, each spray device is associated with a respective basket. In the exemplary considered embodiment in which the dishwasher 100 comprises three baskets, the dishwasher 100 comprises three spray devices. In the exemplary considered embodiment, the dishwasher 100 comprises three spray devices 132, 134, 136 each one associated with a respective basket 112, 114, 116.

According to an embodiment, each spray device 132, 134, 136 comprises a respective wash arm. According to an embodiment, each wash arm is provided with one or more nozzles for causing the washing fluid to be sprayed onto the items to be washed that are housed in the respective basket 112, 114, 116.

According to an embodiment, the dishwasher 100 comprises a flow control device 140 configured to receive the washing fluid pumped by the circulation pump 130 when the latter is controlled to rotate in the forward direction, and to selectively provide (e.g., under the control of the control unit 105) the received washing fluid to one or more selected spray devices among the spray devices 132, 134, 136. In this way, the washing fluid pumped by the circulation pump 130 may be selectively recirculated in the washing tub 110 through the selected spray device(s). According to an embodiment, selective provision of the received washing fluid to the selected spray device(s) may be achieved by selective connection between (i.e., by fluidly connecting in a selective manner) the selected spray device and the circulation pump 130 (e.g., an output thereof).

According to an embodiment, the dishwasher 100 comprises a filter 150. According to an embodiment, the filter 150 is configured to filter soil from the washing fluid before the latter is recirculated into the washing tub 110 by the circulation pump 130 through the selected spray device(s). According to an embodiment, the filter 150 is provided at the sump 124.

According to an embodiment, the dishwasher 100 comprises a drain pump 160. According to an embodiment, the drain pump 160 is configured to be operated (e.g., by, or under the control of, the control unit 105) in an activated condition which causes the washing fluid within the sump 124 to be drained from the dishwasher 100 (e.g., through a corresponding drain outlet 162) and in a deactivated condition which prevents the washing fluid within the sump 124 to be drained from the dishwasher 100.

According to an embodiment (as illustrated in FIG. 1), the dishwasher 100 comprises a circulation pump motor 165 for driving the circulation pump 130. According to an embodiment, the circulation pump motor 165 comprises a respective electric motor and a respective motor command element (such as a TRIAC) for commanding the electric motor.

According to an embodiment, the circulation pump motor 165 is operated by, or under the control of, the control unit 105.

According to an embodiment (as illustrated in FIG. 1), the dishwasher 100 comprises a drain pump motor 166 for driving the drain pump 160. According to an embodiment, the drain pump motor 166 comprises a respective electric motor and a respective motor command element (such as a TRIAC) for commanding the respective electric motor. According to an embodiment, the drain pump motor 166 is operated by, or under the control of, the control unit 105.

Provision of the circulation pump motor 165 and of the drain pump motor 166 allows concurrent and independent driving (or, more generally, concurrent and independent actuation or control) of the circulation pump 130 and of the drain pump 160. However, embodiments are not excluded in which a single motor system configured to selectively drive the circulation pump 130 or the drain pump 160 is provided: in these embodiments, concurrent and independent actuation or control of the circulation 130 and drain 160 pumps may not take place (i.e., concurrent and independent actuation or control of the circulation 130 and drain 160 pumps may be excluded).

According to an embodiment, the dishwasher 100 comprises a water softening system 190.

According to an embodiment, the water softening system 190 is connected between the water inlet 122 and the inlet valve 120.

According to an embodiment, the water softening system 190 is configured to reduce hardness of water fed to the dishwasher 100 through the water inlet 122 (and used for generating the washing fluid). Without losing generality, the water softening system 190 may comprise a softening agent container adapted to contain a water softening agent (e.g., an ion-exchange resin) capable of reducing hardness of water, and a regenerating agent container for storing a regenerating agent, usually salt (e.g., sodium chloride salt) configured to regenerate the softening agent when exhausted.

According to an embodiment, the dishwasher 100 comprises a detection unit 195 (or more thereof).

According to an embodiment, the detection unit 195 is configured to monitor or measure one or more electromechanical parameters of the circulation pump motor 165. Examples of electromechanical parameters of the circulation pump motor 165 include, but are not limited to, an electric current drawn by the circulation pump motor 165, a voltage across the circulation pump motor 165, and/or a torque of the circulation pump motor 165.

According to an embodiment, the detection unit 195 is configured to detect, based on the monitored electromechanical parameter(s), a starvation event or a saturation event.

For the purposes of the present disclosure, a starvation event indicates that air is drawn out by the circulation pump 130, and a saturation event indicates that no air is drawn out by the circulation pump 130. Just as an example, a starvation event may be determined when a current value of the electric current drawn by the circulation pump motor 135 is subjected to a variation (for example, a drop) (e.g., at least equal to a predetermined amount).

According to an embodiment, the detection unit 195 is configured to provide each detected (saturation or starvation) event to the control unit 105.

According to an embodiment, as better discussed in the following, the control unit 105 is configured to determine, based on a trend of the detected (saturation or starvation) events received by the detection unit 195, a saturation state or a starvation state of the circulation pump 130. According to an embodiment, the control unit 105 is configured to determine a saturation state or a starvation state of the circulation pump 130 by running a respective routine (discussed in the following), or more thereof.

Figure 2B:
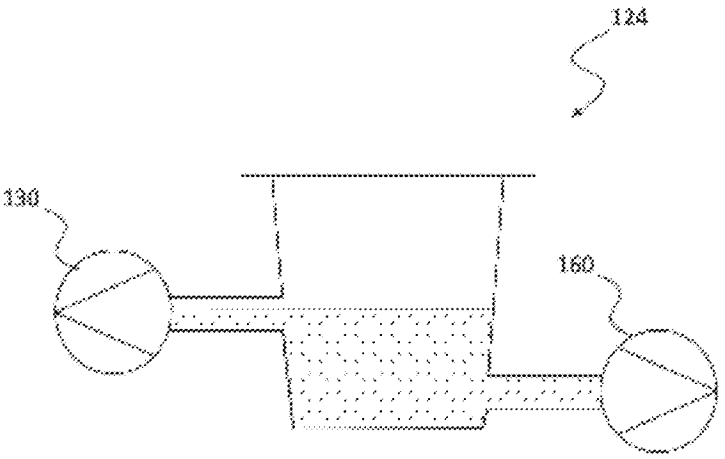
Figure 2A:
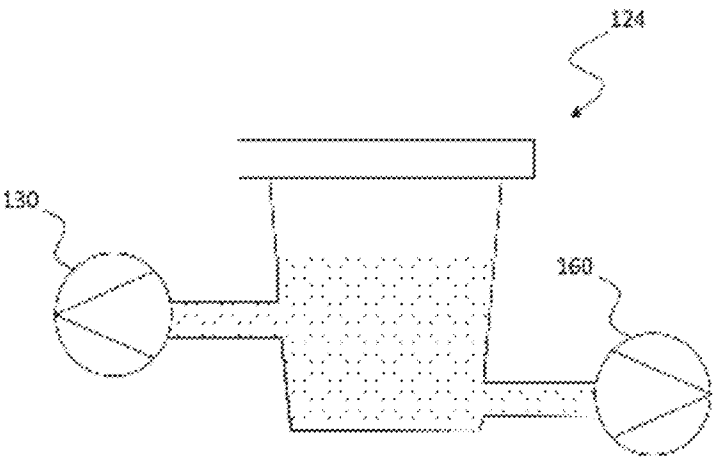

For the purposes of the present disclosure, a saturation state of the circulation pump 130 indicates that sufficient washing fluid is present in the tub 110 to prevent air from being drawn out by the circulation pump 130. In other words, a saturation state of the circulation pump 130 indicates that the amount of washing fluid in the tub 110 is sufficient or high enough to prevent air from being drawn out by the circulation pump 130. An exemplary saturation state of the circulation pump 130 is schematically illustrated in FIG. 2A.

For the purposes of the present disclosure, a starvation state of the circulation pump 130 indicates that insufficient washing fluid is present in the tub 110 to prevent air from being drawn out by the circulation pump 130. In other words, a starvation state of the circulation pump 130 indicates that the amount of washing fluid in the tub 110 is insufficient or not sufficient or not high enough to prevent air from being drawn out by the circulation pump 130. An exemplary starvation state of the circulation pump 130 is schematically illustrated in FIG. 2B.

As better understood from the following discussion, determining the (saturation or starvation) state of the circulation pump 130 based on a trend of the detected (saturation or starvation) events, rather than merely associating each (saturation or starvation) event with the corresponding (saturation or starvation, respectively) state of the circulation pump 130, allows avoiding that a spurious (saturation or starvation) event resulting from transitory or temporary conditions (such as, for example, air bubbles due to turbulent motion of the washing fluid resulting from circulation pump and/or drain pump operation) is erroneously interpreted as, i.e. it is associated with, a (starvation or saturation, respectively) state of the circulation pump 130.

According to an embodiment, the control unit 105 is configured to control the dishwasher 100 based on the determined (starvation or saturation) state of the circulation pump 130. According to an embodiment, the control unit 105 is configured to control a washing fluid filling and/or the circulation pump 130 and/or the drain pump 160 based on the determined (starvation or saturation) state of the circulation pump 130. According to an embodiment, the control unit 105 is configured to control the washing fluid filling and/or the circulation pump 130 and/or the drain pump 160 by running one or more respective routines (as better discussed in the following).

Figure 3:
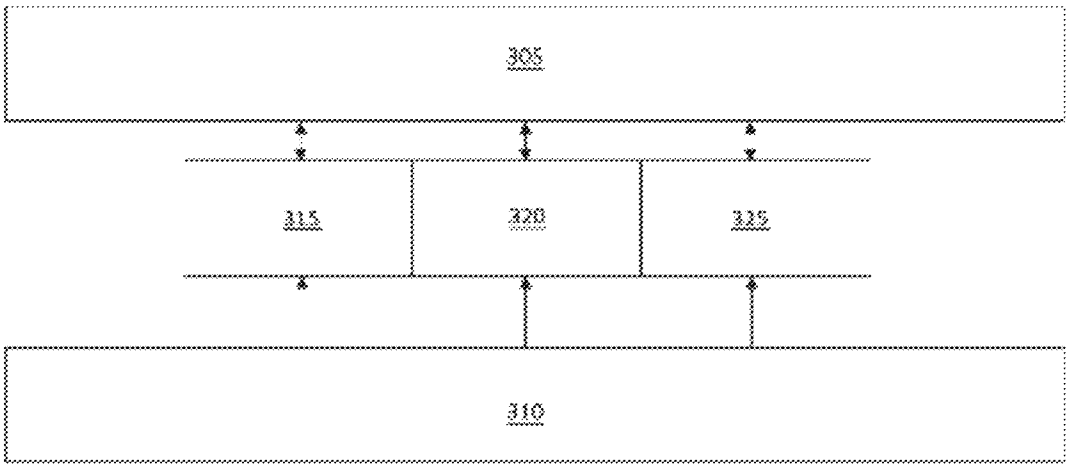
FIG. 3 illustrates, in terms of functional blocks, software/firmware routines that can be run by a control unit of the washing appliance of FIG. 1, according to an embodiment of the present invention.

With reference to FIG. 3, it illustrates in terms of functional blocks exemplary routines that can be run by the control unit 105, according to an embodiment of the present invention. As will be understood form the following description, one or more routines may be run by the control unit 105 concurrently with, and/or in alternative to, and/or by interacting/cooperating with, one or more other routines.

As mentioned above, according to an embodiment the control unit 105 is configured to control the operation of the dishwasher components by running a respective routine (hereinafter, referred to as "washing cycle routine") 305.

According to an embodiment, the washing cycle routine 305 allows the control unit 105 to control the dishwasher components for performing user-selected washing cycles. Just as non-exhaustive examples, based on an ongoing phase of the washing cycle, the washing cycle routine 305 may allow controlling the discharge of detergent into the tub 110, and/or setting a target speed for the recirculation pump 130, and/or selecting the spray device(s) 132, 134, 136, and/or setting the temperature of the washing fluid.

As mentioned above, according to an embodiment the control unit 105 is configured to determine a saturation state or a starvation state of the circulation pump 130 by running a respective routine (hereinafter, referred to as "state routine") 310.

According to an embodiment, the state routine 310 allows the control unit 105 to determine the operative state of the circulation pump 130 based on a trend (e.g., over time) of the (saturation and/or starvation) events detected by the detection unit 195 (and, hence, on the electromechanical parameters of the circulation pump motor 165 monitored or measured by the detection unit 195).

As mentioned above, according to an embodiment the control unit 105 is configured to control the washing fluid filling and/or the circulation pump 130 and/or the drain pump 160 by running one or more respective routines.

According to an embodiment, the control unit 105 is configured to control the washing fluid filling by controlling the switch of the inlet valve 120 between the open and closed conditions according to the starvation state or saturation state of the circulation pump 130.

According to an embodiment, the control unit 105 is configured to control the washing fluid filling by running a respective routine (hereinafter, referred to as "fill routine") 315.

According to an embodiment, the fill routine 315 allows the control unit 105 to control the inlet valve 120 to load in the tub 110 amounts of washing fluid dosed in such a way to allow a correct operation of the dishwasher 100.

According to an embodiment, the control unit 105 is configured to control the circulation pump 130 by running a respective routine (hereinafter referred to as "circulation routine") 320.

According to an embodiment, the circulation routine 320 allows the control unit 105 to efficiently control a current speed of the circulation pump 130 based on a target speed (e.g., of an indication thereof) of the recirculation pump 130.

According to an embodiment, the control unit 105 is configured to concurrently control the washing fluid filling and the circulation pump 130 by running a respective routine (hereinafter referred to as "interaction routine") 325.

According to an embodiment, the interaction routine 325 allows the control unit 105 to control one or more washing filling components allowing the washing fluid filling (such as the inlet valve 120) and one or more pump parameters of the circulation pump 130 (such as current and/or target speeds of the circulation pump 130) based on the starvation state or saturation state of the circulation pump 130, and to control the washing filling component(s) and the pump parameter(s) with respect to each other.

As graphically illustrated in FIG. 3, the fill routine 315, the circulation routine 320, and the interaction routine 325 are configured to operate by taking into account the output produced by the state routine 310 i.e., by taking into account the operative state of the circulation pump 130 (i.e., saturation state or starvation state).

As will be discussed in the following, the fill routine 315, the circulation routine 320, and the interaction routine 325 allow the control unit 105 to efficiently control the operation of the dishwasher 100 without the need that the dishwasher 100 is equipped with a pressure sensor for the determination of the level of washing fluid inside the tub 110. In this way, a correct and reliable operation of the dishwasher 100 can be guaranteed even if no pressure sensor is provided in the dishwasher 100 for the determination of the level of washing fluid inside the tub 110.

Figure 4A:
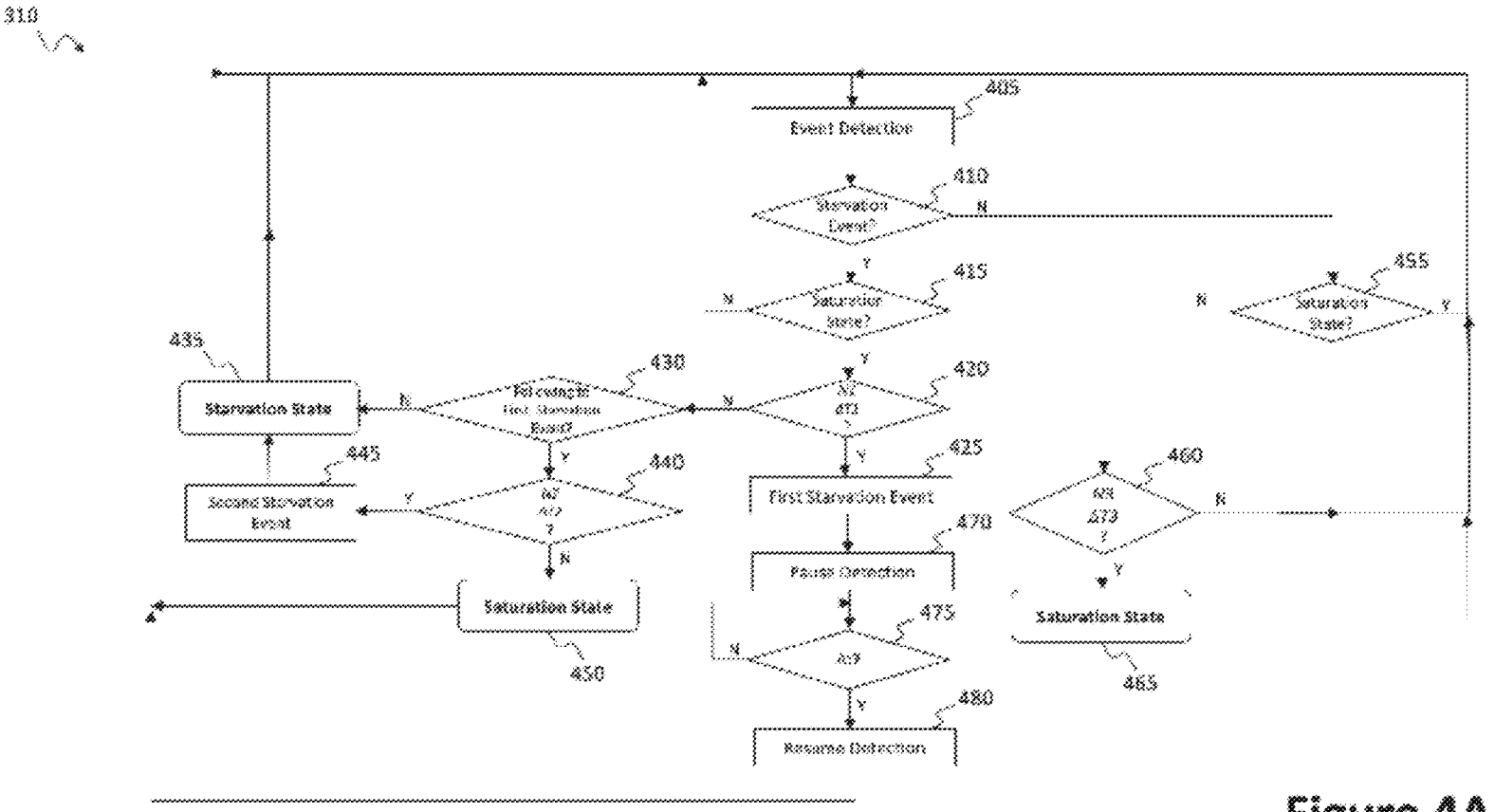
FIG. 4A shows an activity diagram of a software/firmware routine, among the software/firmware routines of FIG. 3, according to an embodiment of the present invention.

With reference now to FIG. 4A, it shows an exemplary activity diagram of the state routine 310, according to an embodiment of the present invention.

Figure 4B:
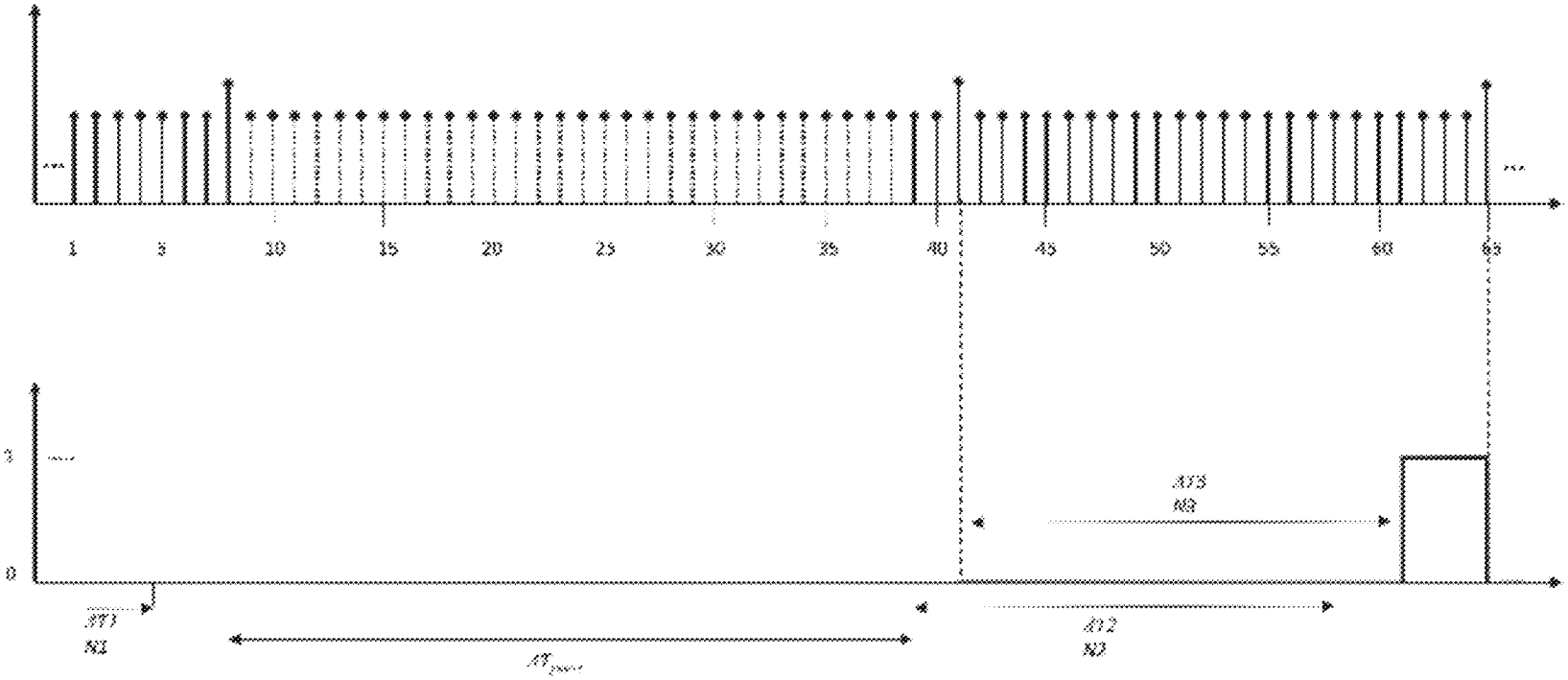
FIG. 4B shows an exemplary trend of saturation and starvation events (top drawing) and an output of the software/firmware routine of FIG. 4A (bottom drawing), according to an embodiment of the present invention.

For the sake of description ease. FIG. 4A will be discussed by making joint reference to FIG. 4B. FIG. 4B shows an exemplary trend of saturation and starvation events detected by the detection unit 195 based on the monitored electromechanical parameter(s) (top drawing), and a corresponding output of the state routine 310 (bottom drawing), according to an embodiment of the present invention.

A number of (e.g., 65) detected events (including both saturation and starvation events) are exemplary represented in the top drawing of FIG. 4B, from a first detected event (labeled by "1" in the abscissae axis) to a last detected event (labeled by "65" in the abscissae axis), it being understood that first and last detected events are not to be construed in absolute terms: indeed, the trend of detected events illustrated in the top drawing of FIG. 4B may represent a subset of saturation and starvation events being detected during a washing cycle of the dishwasher 100.

Saturation and starvation events are graphically distinguished from each other in the top drawing of FIG. 4B: particularly, starvation events are represented as lines having a higher height with respect to the lines representing the saturation events.

According to an embodiment, each detected (saturation or starvation) event may be associated with a respective detection time instant. According to an embodiment, each detection time instant may depend on a detection frequency of the detection unit 195 (i.e., the number of electromechanical parameter(s) measurements per second). According to an embodiment, the detection frequency of the detection unit 195 may be set or controlled or adjusted according to specific design needs, e.g. during a design phase of the dishwasher 100, and/or during a maintenance phase of the dishwasher 100, and/or during an update phase of the dishwasher 100 (such as during an automatic or manual software/firmware update procedure).

Just as an example, the detection frequency of the detection unit 195 may be equal to 10 Hz (which corresponds to 10 electromechanical parameter(s) measurements per second, and hence to 10 detected events per second).

According to an embodiment, the output of the state routine 310 (bottom drawing of FIG. 4B) may comprise a digital signal (hereinafter referred to as output signal). According to an embodiment, the output signal may take a first logic level (e.g., a high logic level) "1" indicative of the saturation state, or a second logic level (e.g., a low logic level) "0" indicative of the starvation state.

Broadly speaking, the state routine 310 determines a starvation state of the circulation pump 130 when both a first starvation event and a second starvation event occurred after the first starvation event are determined, wherein the first starvation event is determined when a starvation event is detected after a first number of consecutive saturation events N1 is counted, or after a first time interval has elapsed during which no starvation event is detected (hereinafter, first time interval without starvation events $\Delta T1$), and the second starvation event is determined when a starvation event is detected before a second number of consecutive saturation events N2 is counted after the first starvation event, or before a second time interval has elapsed after the first starvation event during which no starvation event is detected (hereinafter, second time interval without starvation events $\Delta T2$).

According to an embodiment, consecutive saturation events are counted by means of a proper event counter (not shown). According to an embodiment, the event counter may be an internal entity located within the control unit 105 or within the detection unit 195, or an external entity communicably coupled thereto.

According to an embodiment, time intervals are counted by means of a proper time counter (not shown). According to an embodiment, the time counter may be an internal entity located within the control unit 105 or within the detection unit 195, or an external entity communicably coupled thereto.

According to an embodiment, the first number of consecutive saturation events N1 and the first time interval without starvation events ΔT1 are indicative of a stable saturation state of the circulation pump 130, whereby a starvation event detected after the first number of consecutive saturation events N1 is counted or after the first time interval without starvation events ΔT1 has elapsed, could likely be a spurious starvation event.

According to an embodiment, the first number of consecutive saturation events N1 and the first time interval without starvation events ΔT1 may be set or controlled or adjusted according to specific design needs, for example during a design phase of the dishwasher 100, and/or during a maintenance phase of the dishwasher 100, and/or during an update phase of the dishwasher 100 (such as during an automatic or manual software/firmware update procedure).

Just as an example, the first number of consecutive saturation events N1 may be equal to 300 and the first time interval without starvation events ΔT1 may be equal to 30 seconds.

According to an embodiment, the state routine 310 comprises, in response to detection of an event (action node 405), determining if the detected event is a starvation event or a saturation event (decision node 410).

According to an embodiment, the state routine 310 comprises, if the detected event is a starvation event (exit branch Y of the decision node 410), and if the circulation pump 130 is in the saturation state (exit branch Y of the decision node 415) determining if the detected starvation event may be a spurious starvation event (i.e., if it is a possible spurious starvation event) (decision node 420).

As mentioned above, according to an embodiment, a detected starvation event is a possible spurious starvation event if it has been detected after the first number of consecutive saturation events N1 is counted, or after the first time interval without starvation events ΔT1 has elapsed.

According to an embodiment, the state routine 310 comprises, if the detected starvation event is a possible spurious starvation event (exit branch Y of the decision node 420), the detected event is determined to be (e.g., marked as) the first starvation event (action node 425).

In the example illustrated in FIG. 4B, in which the circulation pump 130 is in the saturation state (output signal at the "1" logic level), the eighth detected event is a starvation event, and this starvation event has been detected after the first number of consecutive saturation events N1 is counted, or after the first time interval without starvation events ΔT1 has elapsed, the eighth detected event is marked as the first starvation event.

Back to the activity diagram, according to an embodiment, after determination of the first starvation event the state routine 310 is restarted as such for the following event detection, and the starvation state of the circulation pump 130 is determined if, as mentioned above, the second starvation event is detected before the second number of consecutive saturation events N2 is counted after the first starvation event, or before the second time interval without starvation events ΔT2 has elapsed from the first starvation event (as better discussed here below).

According to an embodiment, the second number of consecutive saturation events N2 and the second time interval without starvation events ΔT2 may be set or controlled or adjusted according to specific design needs, for example during a design phase of the dishwasher 100, and/or during a maintenance phase of the dishwasher 100, and/or during an update phase of the dishwasher 100 (such as during an automatic or manual software/firmware update procedure).

According to an embodiment, the first number of consecutive saturation events N1 may be higher than second number of consecutive saturation events N2, and the first time interval without starvation events ΔT1 may be higher than second time interval without starvation events ΔT2.

Just as an example, the second number of consecutive saturation events N2 may be equal to 20 and the second time interval without starvation events ΔT2 may be equal to 2 seconds.

According to an embodiment, the second number of consecutive saturation events N2 or the second time interval without starvation events ΔT2 is counted from the first starvation event or after a predefined pause time interval $\Delta T_{pause}$ has elapsed from the first starvation event (as better discussed here below). According to an embodiment, the values of the second number of consecutive saturation events N2 or of the second time interval without starvation events ΔT2 may take into account these counting alternatives.

According to an embodiment, the state routine 310 comprises, if the detected starvation event follows a (previously determined) first starvation event (exit branch Y of decision node 430), determining if the detected starvation event is a second starvation event (decision node 440).

As mentioned above, according to an embodiment, a detected starvation event is a second starvation event if it has been detected before the second number of consecutive saturation events N2 is counted after the first starvation event, or before the second time interval without starvation events ΔT2 has elapsed from the first starvation event.

According to an embodiment, if the detected starvation event has been detected before the second number of consecutive saturation events N2 is counted after the first starvation event, or before the second time interval without starvation events ΔT2 has elapsed after the first starvation event (exit branch Y of the decision node 440), the detected starvation event is determined to be (e.g., marked as) the second starvation event (action node 445), and the starvation state of the circulation pump 130 is determined (action node 435). In other words, according to an embodiment, the state routine 310 comprises determining the starvation state of the circulation pump 130 when both the first starvation event and the second starvation event are determined.

In the example illustrated in FIG. 4B, in which the circulation pump 130 is in the saturation state (output signal at the "1" logic level), the forty-first detected event is a starvation event, and this starvation event has been detected before the second number of consecutive saturation events N2 is counted after the first starvation event, or before the second time interval without starvation events ΔT2 has elapsed from the first starvation even, the forty-first detected event is marked as the second starvation event and the output signal is switched from the "1" logic level to the "0" logic level (which indicates that the starvation state of the circulation pump 130 is determined). In this example, as better discussed in the following, the second number of consecutive saturation events N2 or the second time interval without starvation events ΔT2 are counted after the predefined pause time interval $\Delta T_{pause}$ has elapsed from the first starvation event (although this should not be construed limitatively).

According to an embodiment, if the detected starvation has been detected after the second number of consecutive saturation events N2 is counted after the first starvation event, or after the second time interval without starvation events ΔT2 has elapsed after the first starvation event (exit branch N of the decision node 440), the saturation state of the circulation pump 130 is determined (i.e., confirmed) (action node 450), thereafter the state routine 310 is restarted as such for the following event detection (as conceptually represented in the figure by loop connection between action nodes 450 and 405). In other words, according to an embodiment, the state routine 310 comprises determining the saturation state of the circulation pump 130 if no second starvation event is determined (i.e., if no starvation event is detected before the second number of consecutive saturation events N2 is counted after the first starvation event, or before the second time interval without starvation events ΔT2 has elapsed after the first starvation event).

Back to decision node 410, according to an embodiment, if the detected event is a saturation event (exit branch N of the decision node 410), and if the circulation pump 130 is in the saturation state (exit branch Y of the decision node 455), no actions are taken (in that the detected saturation event is consistent with the saturation state of the circulation pump 130), and the state routine 310 is restarted as such for the following event detection (as conceptually represented in the figure by loop connection between exit branch Y of the decision node 455 and action node 405).

According to an embodiment, the state routine 310 comprises, if the detected event is a saturation event (exit branch N of the decision node 410), and if the circulation pump 130 is in the starvation state (exit branch N of the decision node 455), determining the saturation state of the circulation pump 130 after a third number of consecutive saturation events N3 is counted from determination of the starvation state, or after a third time interval without starvation events ΔT3 has elapsed from determination of the starvation state (see nodes 460 and 465, discussed here below).

According to an embodiment, the third number of consecutive saturation events N3 and the third time interval without starvation events ΔT3 may be set or controlled or adjusted according to specific design needs, for example during a design phase of the dishwasher 100, and/or during a maintenance phase of the dishwasher 100, and/or during an update phase of the dishwasher 100 (such as during an automatic or manual software/firmware update procedure).

Just as an example, the third number of consecutive saturation events N3 may be equal to the second number of consecutive saturation events N3, and the third time interval without starvation events ΔT3 may be equal to the second time interval without starvation events ΔT2.

According to an embodiment, the state routine 310 comprises, if the detected saturation event has been detected after the third number of consecutive saturation events N3 is counted from determination of the starvation state, or after the third time interval without starvation events ΔT3 has elapsed from determination of the starvation state (exit branch Y of the decision node 460), determining the saturation state of the circulation pump 130 (action node 465), thereafter the state routine 310 is restarted as such for the following event detection (as conceptually represented in the figure by loop connection between action nodes 465 and 405).

In the example illustrated in FIG. 4B, in which the circulation pump 130 is in the starvation state (output signal at the "0" logic level) from the forty-first detected event, and the sixty-first detected event is a saturation event detected after the third number of consecutive saturation events N3 is counted after the determination of the starvation state, or after the third time interval without starvation events ΔT3 has elapsed from the determination of the starvation state, at the sixty-first detected event the output signal is switched from the "0" logic level to the "1" logic level (which indicates that the saturation state of the circulation pump 130 is determined).

According to an embodiment, if the detected saturation event has been detected before the third number of consecutive saturation events N3 is counted from determination of the starvation state, or before the third time interval without starvation events ΔT3 has elapsed from the determination of the starvation state (exit branch N of the decision node 460), no actions are taken (i.e., circulation pump 130 still in the starvation state), and the state routine 310 is restarted as such for the following event detection (as conceptually represented in the figure by loop connection between exit branch N of the decision node 455 and action node 405).

Back to decision node 415, according to an embodiment, the state routine 310 comprises, if the detected event is a starvation event (exit branch Y of the decision node 410) and the circulation pump 130 is in the starvation state (exit branch N of the decision node 415), no actions are taken (in that the detected starvation event is consistent with the starvation state of the circulation pump 130), thereafter the state routine 310 is restarted as such for the following event detection (as conceptually represented in the figure by loop connection between exit branch N of the decision node 415 and action node 405).

Back to the action node 425, according to an embodiment the state routine 310 comprises pausing the operation of the detection unit 195 for the predefined pause time interval $\Delta T_{pause}$ after the first starvation event is determined (action node 470), and resuming the operation of the detection unit 195 (action node 480) after the predefined pause time interval $\Delta T_{pause}$ has elapsed (see loop node 475).

According to an embodiment, the predefined pause time interval $\Delta T_{pause}$ may be set or controlled or adjusted according to specific design needs, for example during a design phase of the dishwasher 100, and/or during a maintenance phase of the dishwasher 100, and/or during an update phase of the dishwasher 100 (such as during an automatic or manual software/firmware update procedure).

According to an embodiment, the predefined pause time interval $\Delta T_{pause}$ may be lower than the first time interval without starvation events ΔT1.

According to an embodiment, the predefined pause time interval $\Delta T_{pause}$ may be the amount of time that, in case that a detected starvation event is a spurious starvation event, could be reasonably expected to take by the circulation pump 130 to resolve or substantially resolve any transitory or temporary conditions having determined that spurious starvation event.

Just as an example, the predefined pause time interval $\Delta T_{pause}$ may be equal to 3 seconds (although this should not be construed limitatively).

Back to action node 430, according to an embodiment the state routine 310 comprises, if the detected starvation event is not a possible spurious starvation event (exit branch N of the decision node 420), and if the detected starvation event does not follow a (previously determined) first starvation event (exit branch N of decision node 430), the starvation state of the circulation pump 130 is determined (action node 435), and the state routine 310 is restarted as such for the following event detection (as represented in the figure by loop connection between action nodes 435 and 405). In other words, according to an embodiment, the state routine 310 comprises, with the circulation pump 130 in the saturation state, determining the starvation state of the circulation pump 130 if a starvation event is not a first starvation event and if it does not follow a first starvation event (i.e., if the closest previous starvation event is not a first starvation event).

In the example illustrated in FIG. 4B, in which the circulation pump 130 is in the saturation state (output signal at the "1" logic level) from the sixty-first detected event (and the closest previous starvation event is not a first starvation event), and the sixty-fifth detected event is a starvation event detected before the second number of consecutive saturation events N2 is counted from the determination of the saturation state, or before the second time interval without starvation events ΔT2 has elapsed from the determination of the saturation state, at the sixty-fifth detected event the output signal is switched from the "1" logic level to the "0" logic level (which indicates that the starvation state of the circulation pump 130 is determined).

Figure 5:
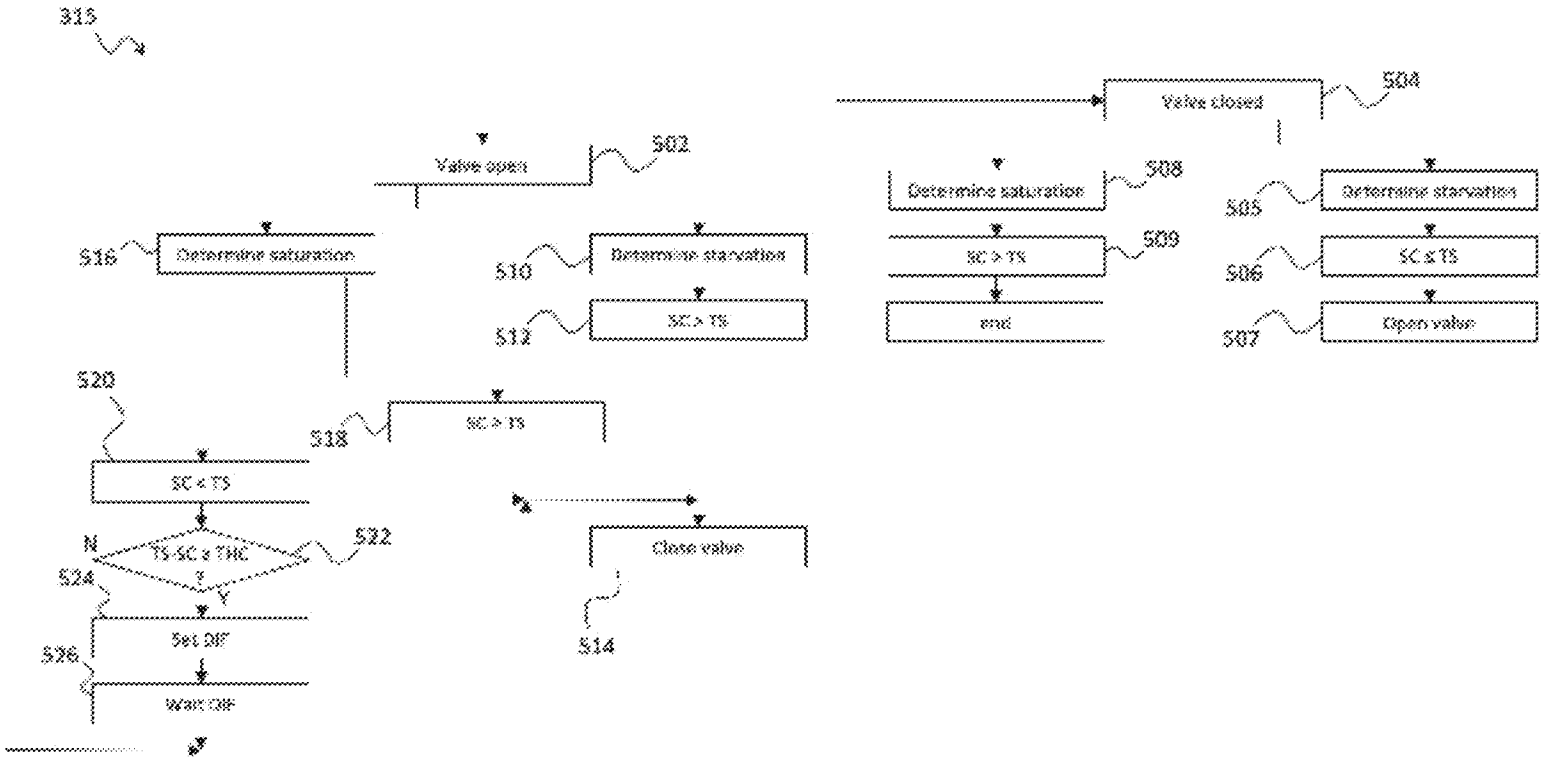
FIG. 5 shows an activity diagram of another software/firmware routine, among the software/firmware routines of FIG. 3, according to an embodiment of the present invention.

With reference now to FIG. 5, it shows an exemplary activity diagram of the fill routine 315, according to an embodiment of the present invention.

Broadly speaking, according to an embodiment of the fill routine 315, the control unit 105 is configured to receive an indication of a current speed of the circulation pump and an indication of a target speed for the circulation pump 130 (the target speed being for example based on a user-selected washing cycle and/or on a phase of the user-selected washing cycle), and to control the switch of the inlet valve 120 by:

causing the inlet valve 120 to switch from the open condition to the closed condition if the following two conditions a) and b) are both true:

a) a saturation state of the circulation pump is determined;

b) the current speed of the circulation pump 130 is lower than or equal to said target speed.

Broadly speaking, according to an embodiment of the fill routine 315, the control unit 105 is configured to control the switch of the inlet valve 120 further by:

delaying the switch of the inlet valve 120 from the open condition to the closed condition by a delay interval if, in addition to have both the conditions a) and b) that are true, the difference between the target speed and the current speed of the circulation pump 130 is higher than a speed threshold.

Broadly speaking, according to an embodiment of the fill routine 315, a duration of the delay interval is based on the difference between the target speed and the current speed of the circulation pump 130.

Broadly speaking, according to an embodiment of the fill routine 315, the control unit 105 is configured to control the washing fluid filling by:

causing the inlet valve 120 to switch from the open condition to the closed condition if, in addition to have the condition a) that is true, the condition b) is not true.

Broadly speaking, according to an embodiment of the fill routine 315, the control unit 105 is configured to control the washing fluid filling by:

causing the inlet valve 120 to switch from the open condition to the closed condition if both the conditions a) and b) are not true.

Broadly speaking, according to an embodiment of the fill routine 315, the control unit 105 is configured to control the washing fluid filling by:

causing the inlet valve 120 to switch from the closed condition to the open condition if, in addition to have the condition b) that is true, the condition a) is not true.

Broadly speaking, according to an embodiment of the fill routine 315, the fill routine 315 provides for causing the inlet valve 120 to be opened in order to fill washing fluid in the tub 110 when the current speed (SC) of the circulation pump 130 is lower than or equal to the target speed (TS) if a starvation state of the circulation pump 130 is determined. According to an embodiment of the fill routine 315, the fill routine 315 also provides for causing the inlet valve 120 to be closed if a saturation state of the circulation pump 130 is determined. According to an embodiment of the fill routine 315, in order to reduce the number of times the inlet valve 120 switches between the open and closed conditions, the closure of the valve is delayed in case the speed SC of the circulation pump 130 is lower than the target speed TS by a sufficiently large amount.

The fill routine 315 will be now discussed by making reference to the activity diagram of FIG. 5.

According to an embodiment, the fill routine 315 may switch between two different states, and namely a so-called "valve open state" (action node 502) corresponding to an open condition of the inlet valve 120 for causing new washing fluid to be fed to the dishwasher 100 for being loaded in the tub 110, and a so-called "valve closed state" (action node 504) corresponding to a closed condition of the inlet valve 120 for preventing new washing fluid to be fed to the dishwasher 100.

The initial state of the fill routine 315 depends on the current state of the inlet valve 120.

Starting from the valve closed state (action node 504), in which the inlet valve 120 is in the closed condition, according to an embodiment, if a starvation state of the circulation pump 130 is determined (action node 505), when the current speed SC of the circulation pump 130 is equal to or lower than the target speed TS (action node 506), the control unit 105 causes the inlet valve 120 to switch to the open condition for causing new washing fluid to be fed in the tub 110 (action node 507). Then, the fill routine 315 switches to the valve open state (going to action node 502).

According to an embodiment, if instead a saturation state of the circulation pump 130 is determined (action node 508), when the current speed SC of the circulation pump 130 is equal to or higher than the target speed TS (action node 509), the fill routine 315 terminates.

According to an embodiment, when the fill routine 315 is in the valve open state (action node 502), and a starvation state of the circulation pump 130 is determined (action node 510), when the current speed SC of the circulation pump 130 is higher than the target speed TS (action node 512), the control unit 105 causes the inlet valve 120 to switch to the closed condition for preventing new washing fluid be fed to the dishwasher 100 (action node 514). Then the fill routine 315 switches the valve closed state (going to action node 504).

According to an embodiment, when the fill routine 315 is in the valve open state (action node 502), and a saturation state of the circulation pump 130 is determined (action node 516), when the current speed SC of the circulation pump 130 is equal to or higher than the target speed TS (action node 518), the control unit 105 causes the inlet valve 120 to switch to the closed condition for preventing new washing fluid be fed to the dishwasher 100 (action node 514). Then, the fill routine 315 switches to the valve closed state (going to action node 504).

According to an embodiment, when the fill routine 315 is in the valve open state (action node 502), and a saturation state of the circulation pump 130 is determined (action node 516), when the current speed SC of the circulation pump 130 is lower than the target speed TS (action node 520), the control unit 105 checks (decision node 522) if the current speed SC is however close to (e.g., only slightly lower than) the target speed TS, or if the current speed SC is still far from (e.g., substantially lower than) the target speed TS.

According to an embodiment, if the difference between the target speed TS and the current speed SC of the circulation pump 130 is not higher than a speed threshold THC (exit branch N of decision node 522), the control unit 105 directly causes the inlet valve 120 to switch to the closed condition for preventing new washing fluid be fed to the dishwasher 100 (action node 514). Then, the fill routine 315 switches to the valve closed state (going to action node 504).

According to an embodiment, if the difference between the target speed TS and the current speed SC of the circulation pump 130 is higher than a speed threshold THC (exit branch Y of decision node 522), the control unit 105 causes a delayed switching of the inlet valve 120 to the closed condition. According to an embodiment, the control unit 105 causes the inlet valve 120 to switch to the closed position only after a delay interval DIF is expired.

According to an embodiment, the speed threshold THC is higher than 100 RPM and lower than 300 RPM, the speed threshold THC being for example equal to 200 RPM.

According to an embodiment, the duration of the delay interval DIF depends on the difference ΔF between the target speed TS and the current speed SC of the circulation pump 130.

According to an embodiment, the control unit 105 sets the delay interval DIF (action node 524) to a value that is proportional to the difference/F between the target speed TS and the current speed SC of the circulation pump 130. According to an embodiment, the delay interval DIF is set to a maximum predetermined value MDIF if the difference ΔF is excessively large. For example, according to an embodiment, the control unit 105 sets the delay interval DIF to the minimum value between:

ΔF*PF, and

MDIF, wherein PF is a proportionality parameter.

For example, MDIF may be set to 10000 ms and PF may be set to 20 ms.

According to an embodiment, when the delay interval DIF is expired (action node 526), the control unit 105 causes the inlet valve 120 to switch to the closed condition for preventing new washing fluid be fed to the dishwasher 100 (action node 514). Then, the fill routine 315 switches to the valve closed state (going to action node 504).

By delaying the closure of the inlet valve 120 when the speed SC is still far from (e.g., substantially lower than) the target speed TS, an additional amount of washing fluid is fed into the tub 110, advantageously reducing the possibility that, once the inlet valve 120 is in the closed condition, the circulation pump 130 enters into the starvation state (with a consequent reopening of the inlet valve 120). In this way, undesired "bouncing" between the open and closed condition of the inlet valve 120 is advantageously reduced.

Thanks to the fill routine 315, it is possible to efficiently control the inlet valve 120 to load in the tub 110 amounts of washing fluid dosed in such a way to allow a correct operation of the dishwasher 100 when the latter is operating with the circulation pump 130 at a current speed SC based on said target speed TS, without requiring the presence of a pressure sensor for the determination of the current level of washing fluid inside the tub 110.

Figure 6A:
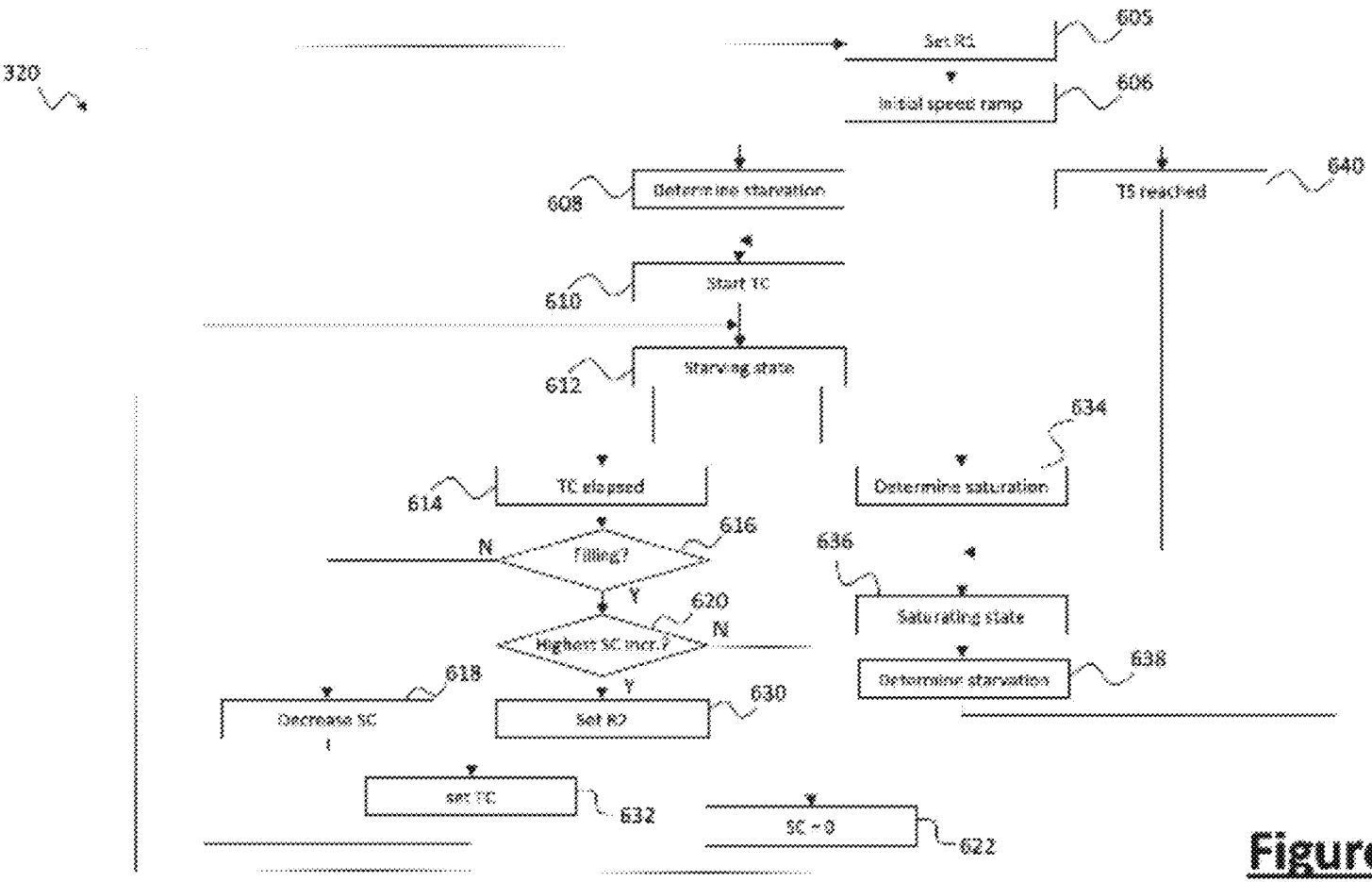
FIG. 6A shows an activity diagram of another software/firmware routine, among the software/firmware routines of FIG. 3, according to an embodiment of the present invention.

With reference now to FIG. 6A, it shows an exemplary activity diagram of the circulation routine 320, according to an embodiment of the present invention.

Broadly speaking, according to an embodiment of the circulation routine 320, the control unit 105 is configured to control the circulation pump 130 by controlling a speed increase rate of the circulation pump 130 from the current speed towards the target speed according to the starvation state or saturation state of the circulation pump 130 and according to the open and closed condition of the inlet valve 120.

Broadly speaking, according to an embodiment of the circulation routine 320, the control unit 105 is configured to cause the current speed of the circulation pump 130 to increase towards the target speed with a first speed increase rate, and to control the speed increase rate of the circulation pump 130 from current speed towards the target speed by:

causing the current speed of the circulation pump 130 to increase towards the target speed with a second speed increase rate lower than the first speed increase rate, if the following two conditions a) and b) are both true:

a) the starvation state of the circulation pump 130 is determined before the speed of the circulation pump 130 has reached the target speed, and b) the inlet valve 120 is in the open condition.

Broadly speaking, according to an embodiment of the circulation routine 320, the control unit 105 is configured to control the circulation pump 130 by causing the current speed of the circulation pump 130 to be decreased if the condition a) is true while condition b) is not true.

Broadly speaking, according to an embodiment of the circulation routine 320, the control unit 105 is configured to control the circulation pump 130 by causing the current speed of the circulation pump 130 to increase towards the target speed with the second speed increase rate if, in addition to have both the conditions a) and b) that are true, no saturation state of the circulation pump 130 is determined during a predetermined time period after the determination of a starvation state of the circulation pump 130.

Broadly speaking, according to an embodiment of the circulation routine 320, the control unit 105 is configured to cause the current speed of the circulation pump 130 to increase towards the target speed with a third speed increase rate lower than the first speed increase rate and higher than the second speed increase rate if the circulation pump 130 has reached the target speed before a starvation state of the circulation pump 130 is determined.

Broadly speaking, according to an embodiment of the circulation routine 320, the control unit 105 is configured to cause the current speed of the circulation pump 130 to increase towards the target speed with the third speed increase rate if, in addition to have the condition a) true, a saturation state of the circulation pump 130 is determined during said predetermined time period.

Broadly speaking, according to an embodiment of the circulation routine 320, the third speed increase rate is equal to:

a first value if the inlet valve 120 is in the open condition;

a second value lower than the first value if the inlet valve 120 is in the closed condition.

Broadly speaking, according to an embodiment, the circulation routine 320 provides for causing the current speed SC of the circulation pump 130 to increase towards the target speed TS with a first speed increase rate R1. If a starvation state of the circulation pump 130 is determined, and at the same time the inlet valve 120 is in the open condition (causing thus washing fluid being loaded into the tub 110) before the current speed SC of the circulation pump 130 reached the target speed TS, the current speed SC of the circulation pump 130 is set to increase towards the target speed TS with a second speed increase rate R2 lower than the first speed increase rate R1.

The circulation routine 320 will be now discussed by making reference to the activity diagram of FIG. 6A.

According to an embodiment, the control unit 105 sets a first increase rate R1 for the speed SC of the circulation pump 130 (action node 605).

Then, according to an embodiment, the circulation routine 320 enters in a so-called "initial speed ramp state" in which the control unit 105 causes the current speed SC of the circulation pump 130 to increase—from a starting value, e.g., equal to zero if the circulation pump 130 is stopped—towards the target speed TS with said first increase rate R1 (action node 606). According to an embodiment, the value of the target speed TS is set by the washing cycle routine 305, depending on a user-selected washing cycle (and/or based on a phase thereof) being currently carried out by the dishwasher 100.

According to an embodiment, the first increase rate R1 is higher than 70 RPM/s, such as for example equal to 80 RPM/s.

According to an embodiment, if a starvation state of the circulation pump 130 is determined (by the state routine 310) before the current speed SC of the circulation pump 130 reached the target speed TS (action node 608), the control unit 105 initializes a timer TC (action node 610) and starts the timer TC to count a predetermined time period (e.g., 200 ms). Then, the circulation routine 320 enters in a so-called "starving state" (action node 612), in which the current speed SC of the circulation pump 130 is caused to increase by the control unit 105 with the actually set increase rate while the circulation pump 130 is determined to be in the starvation state.

According to an embodiment, if the timer TC elapses without having a saturation state of the circulation pump 130 be determined by the state routine 310 (action node 614), the control unit 105 checks if the inlet valve 120 is in the open condition or in the closed position (decision node 616). According to an embodiment, the condition (open or closed) of the inlet valve 120 is set by the fill routine 315.

According to an embodiment, if the inlet valve 120 is in the closed position (exit branch N of decision node 616), meaning that no new washing fluid is being fed into the tub 110 from outside the dishwasher 100, the control unit 105 causes the increasing rate of the current speed SC of the circulation pump 130 to be set to zero, and causes the current speed SC of the circulation pump 130 to be decreased by a corresponding decreasing amount DSC (action node 618).

According to an embodiment, if the inlet valve 120 is in the open condition (exit branch Y of decision node 616), meaning that new washing fluid is being fed into the tub 110 from outside the dishwasher 100, the control unit 105 checks (decision node 620) if the highest value reached by the current speed SC of the circulation pump 130 has been subjected to any increase for a corresponding time period (e.g., 45 s). In case the highest value reached by the current speed SC of the circulation pump 130 did not increase during said time period (exit branch N of decision node 620), the control unit 105 stops (action node 622) the circulation pump 130 for a time interval, such as for 5 s, for removing air from the circulation pump 130, and then the operations flow returns to action node 605. In case the highest value reached by the current speed SC of the circulation pump 130 did increase at least once during said time period (exit branch Y of decision node 620), the control unit 105 causes the current speed SC of the circulation pump 130 to increase towards the target speed TS with a second increase rate R2 lower than the first increase rate R1 (action node 630). According to an embodiment, said decreasing amount DSC is equal to 100 RPM/s. According to an embodiment, said second increase rate R2 is lower than 10 RPM/s, such as for example equal to 5 RPM/s.

Then, the control unit 105 reinitializes the timer TC and starts the timer TC to count a further time period (action node 632), for example 4 s.

At this point, the operations flow returns to action node 612, where the previously described operations are reiterated, with the reinitialised timer TC and the new value of the current speed SC and/or the new value for the increase rate of the current speed SC.

According to an embodiment, if a saturation state of the circulation pump 130 is determined by the state routine 310 before the timer TC elapses (action node 634), after a further time period is expired (e.g., 2 s), the circulation routine 320 enters in a so-called "saturating state" (action node 636), in which the current speed SC of the circulation pump 130 is caused to increase by the control unit 105 with a third increase rate R3 lower than the first increase rate R1 and higher than the second increase rate R2 while the circulation pump 130 is determined to be in the saturation state. According to an embodiment, the value of the third increase rate R3 depends on the condition (open/closed) of the inlet valve 120. According to an embodiment, if the inlet valve 120 is in the open condition, the third increase rate R3 is higher than 50 RPM/s, for example equal to 60 RPM/s, while if the inlet valve 120 is in the closed condition, the third increase rate R3 is lower than 50 RPM/s, for example equal to 40 RPM/s.

Then, according to an embodiment, when a starvation state of the circulation pump 130 is determined again by the state routine 310 (action node 638), the operations flow returns to action node 610, wherein the control unit 105 reinitializes the timer TC and the circulation routine 320 enters again in the starving state (action node 612).

Returning back to action node 606, according to an embodiment, if the current speed SC of the circulation pump 130 reaches the target speed TS before a starvation state of the circulation pump 130 is determined by the state routine 310 (action node 640), the operations flow goes to action node 636, where the circulation routine 320 enters in the saturating state.

When carrying out the circulation routine 320 according to the embodiments illustrated in FIG. 6A, the control unit 105 tries to cause the circulation pump 130 to operate at the target speed TS by increasing the current speed SC of the circulation pump 130 starting from a starting value with a corresponding speed increase rate (action nodes 605, 606). The target speed TS can be reached without causing the circulation pump 130 to enter in the starvation state (action node 640). If the target speed TS cannot be reached without causing a starvation state of the circulation pump 130 (action node 608), the control unit 105 controls the current speed SC to reach the highest speed capable of maintaining the circulation pump 130 in the saturation state. This is done by slowly increasing the current speed SC until a starvation state of the circulation pump 130 is detected, and then:

- if the inlet valve 120 is closed, by lowering the current speed SC until a saturation state of the circulation pump 130 is restored,
- if the inlet valve 120 is open, by increasing the current speed SC at a lower speed increase rate until a saturation state of the circulation pump 130 is restored.

Figure 6B:
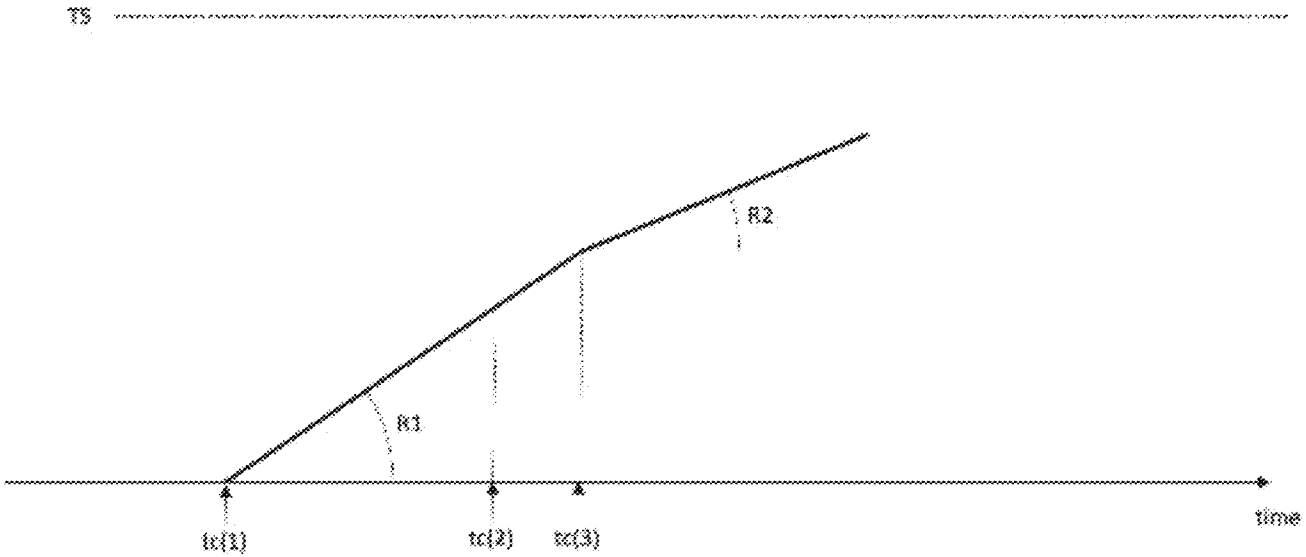
FIG. 6B is an exemplary time diagram showing circulation pump speed variations over time during running of the software/firmware routine of FIG. 6A, according to an embodiment of the present invention.

With joint reference to FIG. 6B, it shows an exemplary time diagram showing circulation pump speed variations over time during running of circulation routine 320.

In the example illustrated in FIG. 6B, the circulation pump 130 is initially turned off, and therefore the current speed SC is equal to zero. At time tc(1), the circulation routine 320 is started, and the control unit 105 causes the circulation pump 130 to increase the current speed SC of the circulation pump 130 with a corresponding first speed increase rate R1 (action nodes 605, 606). At time tc(2), a starvation state of the circulation pump 130 is determined, before the current speed SC of the circulation pump 130 reached the target speed TS (action node 608). At this point, the control unit 105 initializes and starts the timer TC to count a predetermined time period (action node 610). In the considered example, the timer TC expires at time tc(3) before a saturation state of the circulation pump 130 is determined (action node 614). In the considered example, at time tc(3) the inlet valve 120 is in the open condition (exit branch Y of decision node 616), and therefore the control unit 105 verifies if the highest value reached by the current speed SC of the circulation pump 130 has been subjected to any increase during a past time period from time tc(3) (decision node 620). Since in the considered example the current speed SC of the circulation pump 130 was constantly increasing from time tc(1) to time tc(3), this condition is verified (exit branch Y of decision node 620), and therefore the control unit 105 varies the increase rate of the current speed SC of the circulation pump 130 to a second speed increase rate R2 lower than the first speed increase rate R1 (action node 630).

Thanks to the circulation routine 320, it is therefore possible to efficiently control the current speed SC of the circulation pump 130 to reach a value corresponding to a requested target speed TS without requiring the presence of a pressure sensor for the determination of the level of washing fluid currently inside the tub 110.

Figure 7:
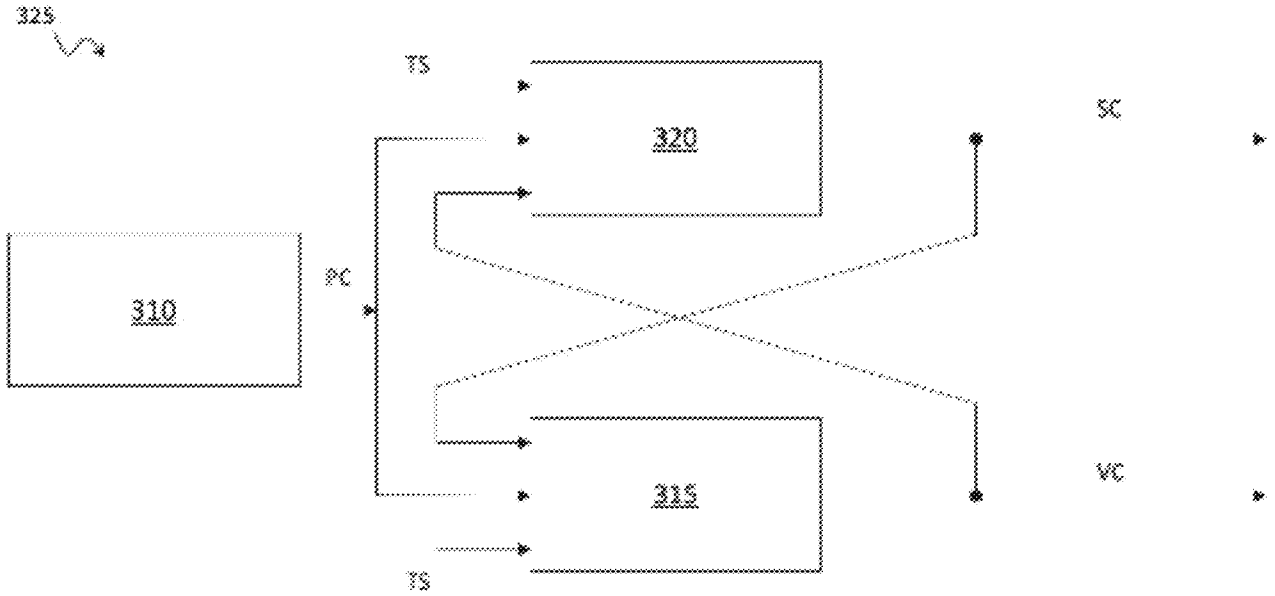
FIG. 7 shows a schematic functional block of another software/firmware routine, among the software/firmware routines of FIG. 3, according to an embodiment of the present invention.

With reference to FIG. 7, it shows, in terms of schematic functional blocks, the interaction routine 325 according to an embodiment of the present invention.

As mentioned above, according to an embodiment, the interaction routine 325 allows the control unit 105 to control one or more washing filling components allowing the washing fluid filling (such as the inlet valve 120) and one or more pump parameters of the circulation pump 130 (such as current and/or target speeds of the circulation pump 130) based on the starvation state or saturation state of the circulation pump 130, and to control the washing filling component(s) and the pump parameter(s) with respect to each other.

According to an embodiment, interaction routine 325 is based on concurrent running of the fill routine 315 and of circulation routine 320.

This is based on the fact that, each one of these two routines (i.e., the fill routine 315 and the circulation routine 320) requires, among its inputs, information that can be output by the other routine.

Particularly, in order to be correctly executed, the circulation routine 320 requires to receive the indication of the target speed TS, an indication of the operative state PC (starvation state or saturation state) of the circulation pump 130, and an indication of the condition VC (open condition or closed condition) of the inlet valve 120. Moreover, in order to be correctly execute, the fill routine 315 requires to receive the indication of the target speed TS, the indication of the operative state PC of the circulation pump 130, and an indication of the current speed SC of the circulation pump 130.

By making reference to the schematic functional block of FIG. 7, since the current speed SC of the circulation pump 130 is set by the circulation routine 320 (based on TS, PC, VC), and the condition VC of the inlet valve 120 is set by the fill routine 315 (based on TS, PC, SC), according to an embodiment the circulation routine 320 and the fill routine 315 may be advantageously executed concurrently, using the indication of the condition VC of the inlet valve 120 set by the fill routine 315 as an input for the circulation routine 320, and using the indication of the current speed SC of the circulation pump 130 set by the circulation routine 320 as an input for the fill routine 315.

According to an embodiment, when the circulation routine 320 and the fill routine 315 are concurrently executed, each one of said routines may operate by using a respective different target speed TS.

According to an embodiment, the control unit 105 may control the current speed SC of the circulation pump 130 (by running the circulation routine 320) based on:

- a first target speed TS1;
- the indication of the condition VC of the inlet valve 120;
- the indication of the operative state PC of the circulation pump 130.

According to an embodiment, the control unit 105 may control the condition VC of the inlet valve 120 (by running the fill routine 315) based on:

- a second target speed TS2;
- the indication of the current speed SC of the circulation pump 130;
- the indication of the operative state PC of the circulation pump 130.

For example if the first target speed TS1 is set to a value higher than the value of the second target speed TS2 (e.g., TS1 is set to 2000 RPM, and TS2 is set to 1800 RPM), as long as the current speed SC of the circulation pump 130 is equal to or lower than TS2, both the two routines are carried out by the control unit 105. When the current speed SC of the circulation pump 130 is higher than TS2, the fill routine 240 is prevented to cause the opening of the inlet valve 120.

Naturally, in order to satisfy local and specific requirements, a person skilled in the art may apply to the invention described above many logical and/or physical modifications and alterations. More specifically, although the present invention has been described with a certain degree of particularity with reference to preferred embodiments thereof, it should be understood that various omissions, substitutions and changes in the form and details as well as other embodiments are possible. In particular, different embodiments of the invention may even be practiced without the specific details set forth in the preceding description for providing a more thorough understanding thereof; on the contrary, well-known features may have been omitted or simplified in order not to encumber the description with unnecessary details. Moreover, it is expressly intended that specific elements and/or method steps described in connection with any disclosed embodiment of the invention may be incorporated in any other embodiment.

The invention claimed is:

1. A washing appliance comprising:

a tub;

a circulation pump to circulate a washing fluid in the tub;

a circulation pump motor to drive the circulation pump;

a drain pump;

a detection unit configured to monitor at least one electromechanical parameter of the circulation pump motor, and to detect, based on the monitored at least one electromechanical parameter, a starvation event indicating that air is drawn out by the circulation pump or a saturation event indicating that no air is drawn out by the circulation pump; and a control unit configured to determine a first starvation event and a second starvation event occurred after the first starvation event, wherein the first starvation event is determined when a starvation event is detected after a first number of consecutive saturation events (N1) is counted, or after a first time interval (ΔT1) has elapsed during which no starvation event is detected, wherein the second starvation event is determined when a starvation event is detected before a second number of consecutive saturation events (N2) is counted after the first starvation event, or before a second time interval (ΔT2) has elapsed after the first starvation event during which no starvation event is detected, wherein the first number of consecutive saturation events (N1) is higher than the second number of consecutive saturation events (N2) and the first time interval (ΔT1) is higher than the second time interval (ΔT2);

and wherein the control unit is configured to:

determine a starvation state of the circulation pump when both the first starvation event and the second starvation event are determined, the starvation state indicating that insufficient washing fluid is present in the tub to prevent air from being drawn out by the circulation pump;

determine a saturation state of the circulation pump if the second starvation event is not determined, the saturation state indicating that sufficient washing fluid is present in the tub to prevent air from being drawn out by the circulation pump; and control the washing appliance based on the determined starvation state or saturation state of the circulation pump.

2. The washing appliance of claim 1, wherein, after the starvation state is determined, the control unit is configured to determine a saturation state of the circulation pump after a third number of consecutive saturation events (N3) is counted from determination of the starvation state, or after a third time interval (ΔT3) has elapsed from determination of the starvation state during which no starvation event is detected.

3. The washing appliance of claim 2, wherein the second number of consecutive saturation events (N2) is equal to the third number of consecutive saturation events (N3), and the second time interval (ΔT2) is equal to the third time interval (ΔT3).

4. The washing appliance of claim 1, wherein, with the circulation pump in the saturation state, the control unit is configured to determine a starvation state of the circulation pump if a third starvation event is detected before the first number (N1) of consecutive saturation events is counted from determination of the saturation state, or before the first time interval (ΔT1) has elapsed from determination of the saturation state, the third starvation event not following the first starvation event.

5. The washing appliance of claim 1, wherein the control unit is configured to pause the operation of the detection unit for a predefined time interval ($\Delta T_{pause}$) after the first starvation event is determined, and to resume the operation of the detection unit after the predefined time interval has elapsed.

6. The washing appliance of claim 5, wherein the predefined time interval ($\Delta T_{pause}$) is lower than the first time interval (ΔT1).

7. The washing appliance of claim 1, wherein the first number of consecutive saturation events (N1) and the first time interval (ΔT1) are indicative of a stable saturation state of the circulation pump.

8. The washing appliance of claim 7, wherein the at least one parameter comprises an electric current of the circulation pump motor.

9. The washing appliance of claim 1, wherein the control unit is configured to control the washing appliance based on the determined starvation state or saturation state of the circulation pump by controlling a washing fluid filling and/or the circulation pump and/or the drain pump.

10. The washing appliance of claim 9, further comprising an inlet valve operable to be selectively switched between an open condition for causing the washing fluid to be loaded into the tub and a closed condition for preventing the washing fluid be fed to the appliance, wherein the control unit is configured to control a washing fluid filling by controlling a switch of the inlet valve between the open and closed conditions according to the starvation state or saturation state of the circulation pump.

11. The washing appliance of claim 10, wherein the control unit is configured to receive an indication of a current speed of the circulation pump and an indication of a target speed for the circulation pump, wherein the target speed is based on a user-selected washing cycle and/or on a phase of the user-selected washing cycle, and wherein the control unit is configured to control a switch of the inlet valve by:

causing the inlet valve to switch from the open condition to the closed condition if the following two conditions a) and b) are both met:

a) a saturation state of the circulation pump is determined; and b) the current speed of the circulation pump is lower than or equal to the target speed.

12. The washing appliance of claim 11, wherein the control unit is configured to control a switch of the inlet valve further by:

delaying the switch of the inlet valve from the open condition to the closed condition by a delay interval if, in addition to have both the conditions a) and b) met, the difference between the target speed and the current speed of the circulation pump is higher than a speed threshold.

13. The washing appliance of claim 12, wherein a duration of the delay interval is based on the difference between the target speed and the current speed of the circulation pump.

14. The washing appliance of claim 9, further comprising an inlet valve operable to be selectively switched between an open condition for causing the washing fluid to be loaded into the tub and a closed condition for preventing the washing fluid be fed to the appliance, wherein the control unit is configured to receive an indication of a current speed of the circulation pump and an indication of a target speed for the circulation pump and to cause the current speed of the circulation pump to increase towards the target speed, and wherein the control unit is configured to control the circulation pump by controlling a speed increase rate of the circulation pump from current speed towards the target speed according to the starvation state or saturation state of the circulation pump and according to the open and closed condition of the inlet valve.

15. The washing appliance of claim 14, wherein the control unit is configured to cause the current speed of the circulation pump to increase towards the target speed with a first speed increase rate, and wherein the control unit is configured to control the speed increase rate of the circulation pump from the current speed towards the target speed by:

causing the current speed of the circulation pump to increase towards the target speed with a second speed increase rate lower than the first speed increase rate, if the following two conditions a) and b) are both met:

a) the starvation state of the circulation pump is determined before the speed of the circulation pump has reached the target speed; and b) the inlet valve is in the open condition.

16. The washing appliance of claim 15, wherein the control unit is configured to control the circulation pump by causing the current speed of the circulation pump to be decreased if the condition a) is met while condition b) is not met.

17. The washing appliance of claim 15, wherein the control unit is configured to control the circulation pump by causing the current speed of the circulation pump to increase towards the target speed with the second speed increase rate if, in addition to have both the conditions a) and b) met, no saturation state of the circulation pump is determined during a predetermined time period after the determination of a starvation state of the circulation pump.

18. The washing appliance of claim 14, wherein the target speed depends on a user-selected washing cycle being carried out by the washing appliance and/or by a phase of the user-selected washing cycle being carried out by the washing appliance.

19. The washing appliance of claim 9, wherein the control unit is configured to control the washing fluid filling and the circulation pump by controlling at least one washing filling component allowing the washing fluid filling and at least one pump parameter of the circulation pump based on the starvation state or saturation state of the circulation pump, and by controlling the at least one washing filling component and the at least one pump parameter with respect to each other.

20. The washing appliance of claim 19, wherein the at least one washing filling component comprises an inlet valve operable to be selectively switched between an open condition for causing the washing fluid to be loaded into the tub and a closed condition for preventing the washing fluid be fed to the appliance, and wherein the at least one pump parameter comprises a target speed of the circulation pump based on a user-selected washing cycle and/or on a phase thereof and a current speed of the circulation pump, and wherein the control unit is configured to control the washing fluid filling and the circulation pump by:

controlling the current speed of the circulation pump based on the target speed;

the inlet valve condition; and the starvation state or the saturation state of the circulation pump; and operating the inlet valve based on:

the target speed;

the current speed of the circulation pump; and the starvation state or the saturation state of the circulation pump.

* * * * *